US009765999B2

(12) United States Patent
Michitsuji et al.

(10) Patent No.: US 9,765,999 B2
(45) Date of Patent: Sep. 19, 2017

(54) AIR CONDITIONER

(71) Applicant: DAIKIN INDUSTRIES, LTD., Osaka-shi, Osaka (JP)

(72) Inventors: Yoshiharu Michitsuji, Sakai (JP); Yoshiteru Nouchi, Sakai (JP); Wataru Egawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 191 days.

(21) Appl. No.: 14/377,565

(22) PCT Filed: Jan. 30, 2013

(86) PCT No.: PCT/JP2013/000497
§ 371 (c)(1),
(2) Date: Aug. 8, 2014

(87) PCT Pub. No.: WO2013/118465
PCT Pub. Date: Aug. 15, 2013

(65) Prior Publication Data

US 2015/0000332 A1 Jan. 1, 2015

(30) Foreign Application Priority Data

Feb. 10, 2012 (JP) ..... 2012-027205

(51) Int. Cl.
*F25B 39/02* (2006.01)
*F28F 9/02* (2006.01)
(Continued)

(52) U.S. Cl.
CPC ..... *F25B 39/028* (2013.01); *F24F 1/0059* (2013.01); *F25B 41/00* (2013.01);
(Continued)

(58) Field of Classification Search
CPC .... F24F 1/32; F24F 2001/0037; F24F 1/0059; F28F 9/0275; F25B 41/00; F25B 39/028
See application file for complete search history.

(56) References Cited

U.S. PATENT DOCUMENTS 2,803,116 A * 8/1957 Tilney ..... F25B 39/028 137/14
3,563,055 A * 2/1971 Owens ..... F25B 39/028 137/602
(Continued)

FOREIGN PATENT DOCUMENTS

JP 51-52962 5/1976
JP 9-138036 A 5/1997
(Continued)

OTHER PUBLICATIONS

International Search Report issued in PCT/JP2013/000497, mailed on May 7, 2013.

*Primary Examiner* — Emmanuel Duke
(74) *Attorney, Agent, or Firm* — Birch, Stewart, Kolasch & Birch, LLP

(57) ABSTRACT

The present invention is characterized in that: a flow diverter provided in an air conditioner has a flow diverter main body having an internal space, and a first connection portion to which a pipe is connected; the first connection portion has an inner peripheral surface that defines a hole through which the pipe is inserted; the inner peripheral surface has, in the direction of a central axis, a brazing portion which is provided at a location containing an end on the side where the pipe is inserted, and forms a gap filled with solder for brazing between the inner peripheral surface and an outer peripheral surface of the pipe, and a restricting portion located closer to the flow diverter main body than to the
(Continued)

brazing portion; and the inner diameter of the restricting portion is smaller than the inner diameter of the brazing portion.

10 Claims, 10 Drawing Sheets

(51) Int. Cl.

| | |
|---|---|
| ***F25B 41/00*** | (2006.01) |
| ***F24F 1/00*** | (2011.01) |
| *F25B 13/00* | (2006.01) |
| *F24F 1/32* | (2011.01) |

(52) U.S. Cl.
CPC ..... *F28F 9/0275* (2013.01); *F24F 1/32* (2013.01); *F24F 2001/0037* (2013.01); *F25B 13/00* (2013.01)

(56) References Cited

U.S. PATENT DOCUMENTS 3,864,938 A * 2/1975 Hayes, Jr. ..... F25B 41/06 137/14
3,920,176 A 11/1975 Becker et al.
4,430,868 A * 2/1984 Kern ..... F25B 39/028 62/504
4,457,364 A * 7/1984 DiNicolantonio ..... C10G 9/002 165/134.1
5,059,226 A * 10/1991 Schneider ..... F25B 39/028 55/459.1
5,241,867 A * 9/1993 Cohen ..... G01N 1/18 137/561 A
5,243,838 A * 9/1993 Ide ..... F25B 39/028 62/504
2010/0115979 A1* 5/2010 Lee ..... F25B 39/028 62/259.1
2010/0313585 A1* 12/2010 Parker ..... F25B 39/028 62/208

FOREIGN PATENT DOCUMENTS

| | | | | |
|---|---|---|---|---|
| JP | 10-9716 | A | | 1/1998 |
| JP | 2001-87853 | A | | 4/2001 |
| JP | 2001087853 | A | * | 4/2001 |
| JP | 2003-35471 | A | | 2/2003 |
| JP | 2003035471 | A | * | 2/2003 |
| JP | 2003-222439 | A | | 8/2003 |
| JP | 2004-177059 | A | | 6/2004 |
| JP | 2004177059 | A | * | 6/2004 |
| JP | 2005-114214 | A | | 4/2005 |
| JP | 2006-349238 | A | | 12/2006 |

* cited by examiner

AIR CONDITIONER

TECHNICAL FIELD

The present invention relates to an air conditioner that performs a vapor-compression refrigeration cycle by circulating a refrigerant.

BACKGROUND ART

Patent Document 1 discloses an air conditioner with a flow diverter. The flow diverter is disposed between an expansion valve and a heat exchanger with a plurality of heat transfer pipes in a refrigerant circuit of the air conditioner. This flow diverter allows diversion of the refrigerant flowing from the expansion valve and then sends the refrigerant to each of the heat transfer pipes of the heat exchanger. A plurality of branched pipes connected to each of the heat transfer pipes of the heat exchanger and an expansion valve-side pipe communicating with the expansion valve are connected to the flow diverter.

Specifically, the flow diverter has a flow diverter main body 101, a first connection portion 102 which is provided at one end of the flow diverter main body 101 and to which an expansion valve-side pipe 110 is connected, and a second connection portion 103 which is provided at the other end of the flow diverter main body 101 and to which are connected a plurality of branched pipes 112, 112 . . . connected to each of the heat transfer pipes of the heat exchanger, as shown in FIGS. 11A and 11B.

The first connection portion 102 is in the shape of a cylinder with open ends. The first connection portion 102 has the expansion valve-side pipe 110 inserted therein and is brazed to the expansion valve-side pipe 110. Each of the branched pipes 112 is connected to the second connection portion 103. The branched pipes 112 are provided side-by-side at intervals on the circumference 104 of a circle around a central axis c1 of the first connection portion 102.

In this flow diverter 100, the refrigerant flowing from the expansion valve flows from one end of the flow diverter main body 101 to the other end thereof. The refrigerant is then divided by flowing into the branched pipes 112 connected to the second connection portion 103. Here, in the second connection portion 103, the plurality of branched pipes 112, 112 . . . are provided side-by-side at intervals on the circumference 104 around the central axis c1 of the first connection portion 102. Therefore, by connecting the expansion valve-side pipe 110 to the first connection portion 102 in such a manner that the central axis of the expansion valve-side pipe 110 is in line with the central axis c1 of the first connection portion 102, the flow diverter 100 can uniformly divide the refrigerant from the expansion valve-side pipe 110 into the branched pipes 112. In other words, when the refrigerant flows from the expansion valve toward the heat exchanger in the refrigerant circuit, the refrigerant flows toward the second connection portion 103 into the flow diverter main body 101 in the direction of the central axis c1 of the first connection portion 102. Furthermore, in the flow diverter main body 101, the branched pipes 112 are equally distant from the expansion valve-side pipe 110. For this reason, the refrigerant can uniformly flow into the branched pipes 112 after passing through the flow diverter main body 101. As a result, the air conditioner with this flow diverter 100 can prevent the refrigerant from flowing non-uniformly into the heat transfer pipes of the heat exchanger at varying flow rates and inhibit deterioration of heat exchange efficiency of the refrigerant that can be caused by the varying flow rates thereof in the heat transfer pipes.

When connecting the expansion valve-side pipe 110 to the flow diverter 100 at the time of production of the air conditioner, the expansion valve-side pipe 110, the expansion valve-side pipe 110 is inserted into the first connection portion 102 of the flow diverter 100 and brazed to the first connection portion 102 in inserted condition. In so doing, sometimes the expansion valve-side pipe 110 is connected (brazed) to the flow diverter 100, with the central axis c2 of the expansion valve-side pipe 110 being inclined with respect to the central axis c1 of the first connection portion 102, as shown in FIG. 12. This happens because the inner diameter b1 of the inner peripheral surface of the first connection portion 102 is set so that the space for pouring (to be filled with) solder for brazing and for ensuring brazing strength is formed between this inner peripheral surface and the outer peripheral surface of the expansion valve-side pipe 110.

Connecting the expansion valve-side pipe 110 to the flow diverter 100 while the expansion valve-side pipe 110 is inclined as described above creates imbalance in the flow rate of the refrigerant flowing into the branched pipes 112 through the flow diverter 100. That is described hereinafter in more detail.

When the expansion valve-side pipe 110 is connected to the flow diverter 100 while inclined, the refrigerant flowing from the expansion valve toward the heat exchanger in the refrigerant circuit flows into the flow diverter 100 in a direction that is inclined with respect to the direction of the central axis c1 of the first connection portion 102. In addition, the branched pipes 112 that are disposed on the circumference 104 in the second connection portion 103 are apart from the expansion valve-side pipe 110 of the flow diverter 100 by varying distances. This causes imbalance in the flow rate of the refrigerant flowing into the branched pipes 112 through the flow diverter 100. This means that the flow diverter 100 cannot uniformly divide the refrigerant flowing from the expansion valve-side pipe 110 into the branched pipes 112.

In this case, the efficiency of exchanging heat between the refrigerant and outside air in the heat exchanger deteriorates due to the imbalance in the flow rate of the refrigerant in the heat transfer pipes of the heat exchanger.

Patent Document 1: Japanese Patent Application Publication No. 2003-35471

SUMMARY OF THE INVENTION

An object of the present invention is to provide an air conditioner that has a flow diverter capable of preventing an expansion valve-side pipe from tilting when brazing the expansion valve-side pipe to a first connection portion of the flow diverter at the time of production of the air conditioner.

According to one aspect of the present invention, an air conditioner has: a plurality of branched pipes that are connected to a heat exchanger; an expansion valve-side pipe that leads to an expansion valve, and a flow diverter that is capable of dividing a refrigerant flowing from the expansion valve-side pipe and then sending the refrigerant to each of the branched pipes. The flow diverter has a first connection portion that is connected to the expansion valve-side pipe and thereby communicates the inside of the expansion valve-side pipe with an internal space of the flow diverter, and a second connection portion to which each of the plurality of branched pipes is connected and which communicates the inside of each branched pipe with the internal space. The first connection portion has an inner peripheral surface that defines a pipe connection hole to which the expansion valve-side pipe is fixed, with the expansion valve-side pipe being inserted thereto, while the second connection portion is provided with the branched pipes disposed side-by-side at intervals on a circumference of a circle around a central axis of the pipe connection hole. The inner peripheral surface has, in the direction of the central axis, a brazing portion which is provided at a location containing an end on the side where the expansion valve-side pipe is inserted, and forms a gap filled with solder for brazing between the inner peripheral surface and an outer peripheral surface of the expansion valve-side pipe, and a restricting portion for restricting inclination of the expansion valve-side pipe at the time of brazing. The inner diameter of the restricting portion is smaller than that of the brazing portion.

BEST MODE FOR CARRYING OUT THE INVENTION

An embodiment of the present invention is now described hereinafter with reference to the accompanying drawings.

Figure 1:
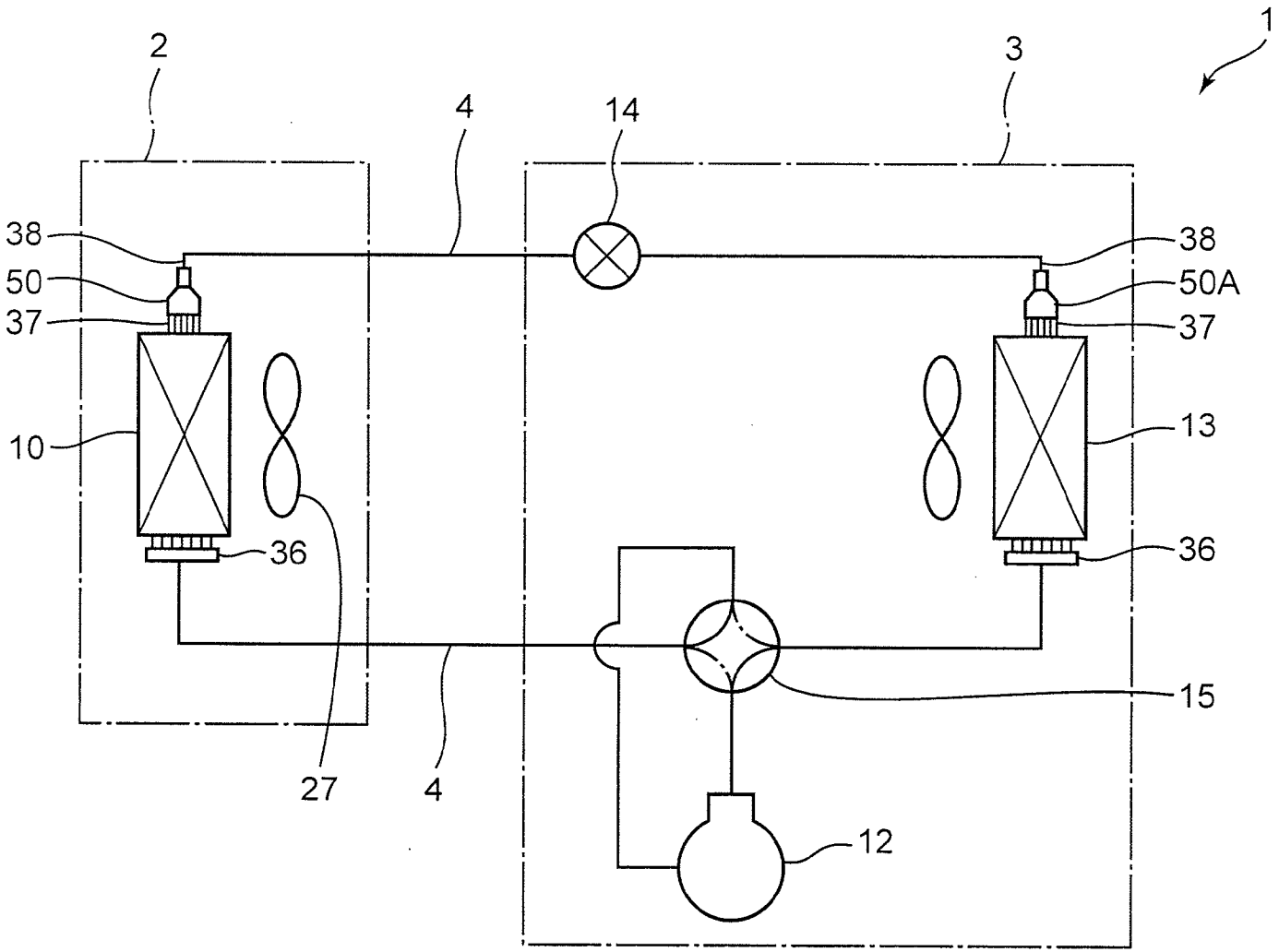
FIG. 1 is a schematic configuration diagram of an air conditioner according to an embodiment.

An air conditioner according to the present embodiment has an indoor unit 2 and an outdoor unit 3, as shown in FIG. 1. The indoor unit 2 and the outdoor unit 3 are connected to each other by pipes 4, 4 and thereby configure a refrigerant circuit. Specifically, the indoor unit 2 has an indoor-side heat exchanger 10, a first flow diverter 50, and a blower 27. The outdoor unit 3 has a compressor 12, an outdoor-side heat exchanger 13, a second flow diverter 50A, an expansion valve 14, and a four way valve 15. The main components of the refrigerant circuit are the indoor-side heat exchanger 10, the compressor 12, the outdoor-side heat exchanger 13, and the expansion valve 14. In this air conditioner 1, the direction of circulation of a refrigerant in the refrigerant circuit is switched by switching the four way valve 15. As a result, switching between the cooling operation and the heating operation is performed in the air conditioner 1.

Figure 2:
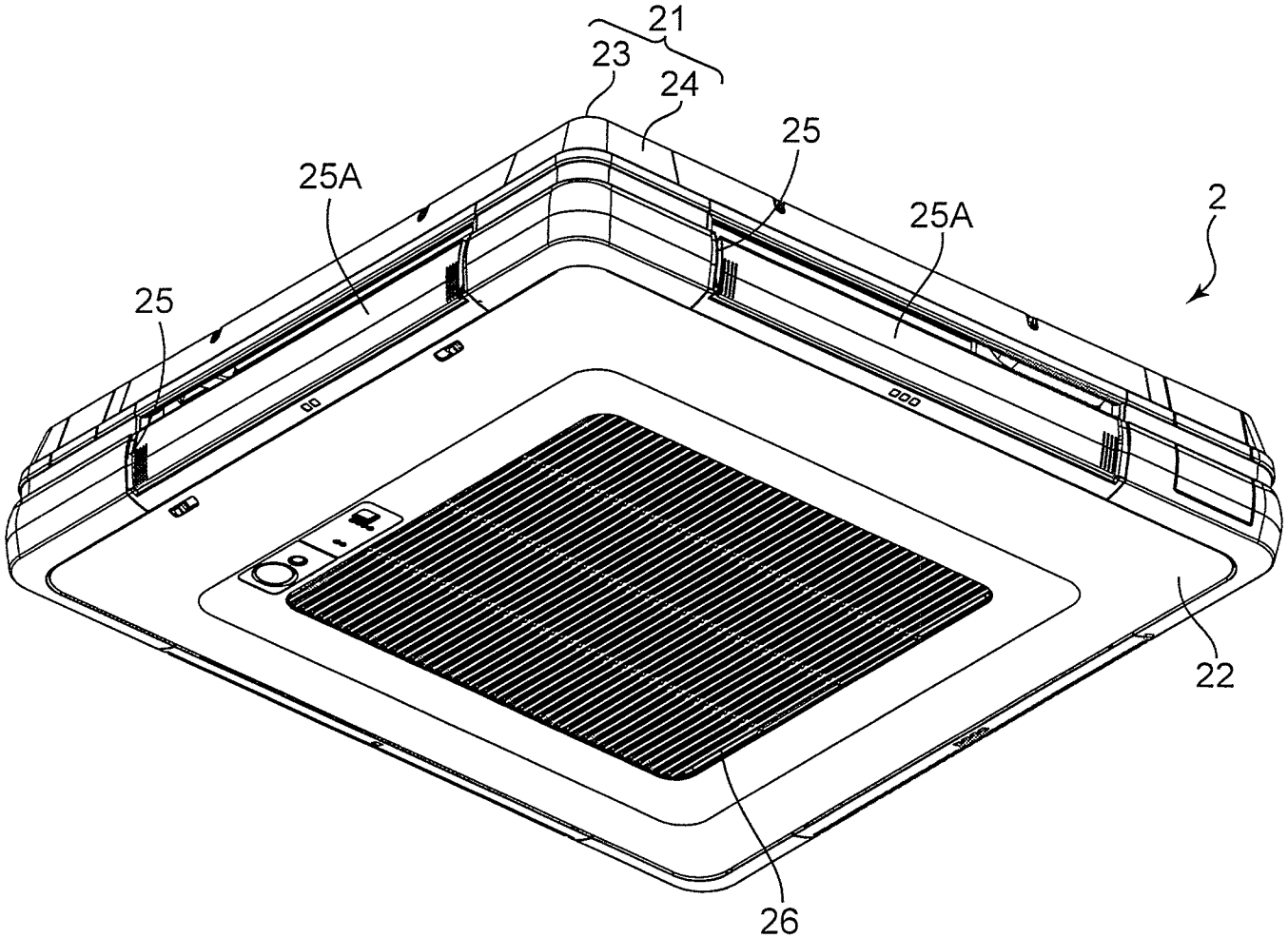
FIG. 2 is a perspective view of an indoor unit of the air conditioner.
Figure 3:
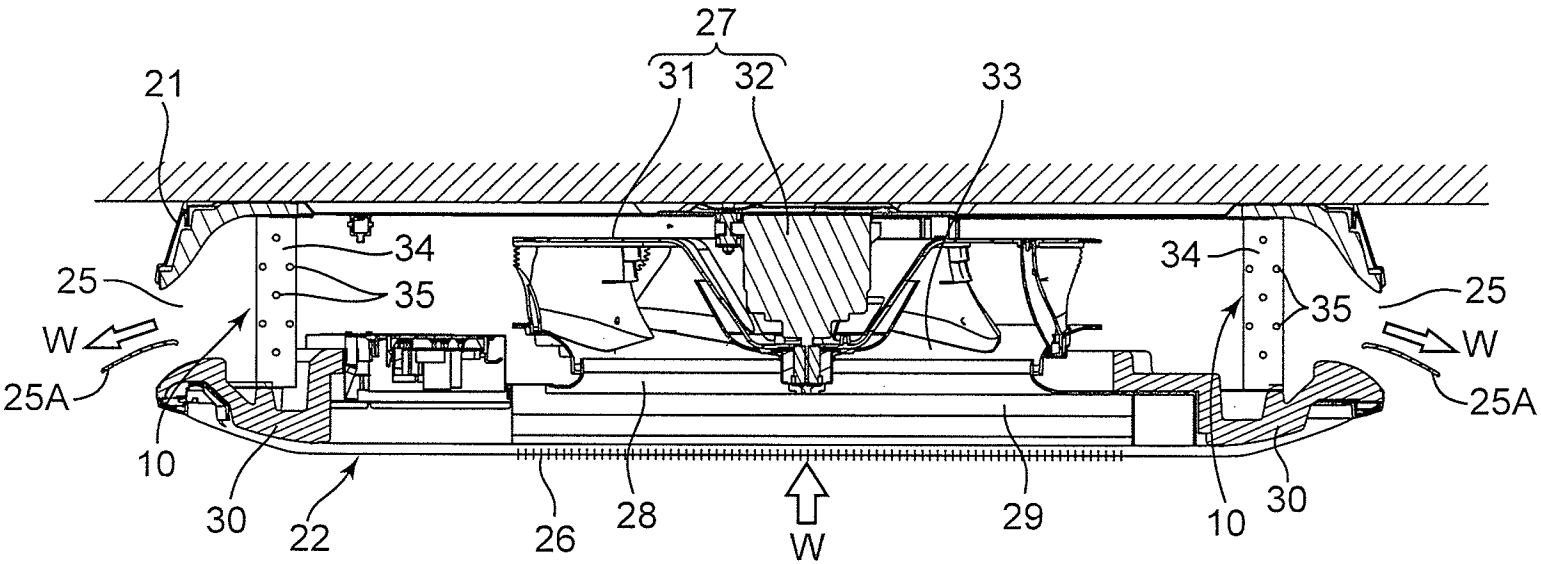
FIG. 3 is a vertical cross-sectional diagram of the indoor unit.

The indoor unit 2 is of a ceiling-suspended type (so-called suspended type). As shown in FIGS. 2 and 3 as well, the indoor unit 2 has a casing 21 that is suspended from the ceiling using suspending members extending from the ceiling, such as bolts, and a decorative panel 22 attached to a lower portion of the casing 21. The casing 21 has a substantially square top panel 23 and side walls 24 extending downward from a rim of the top panel 23. An air outlet 25 is provided at a substantially central portion in the horizontal direction in each of the side walls 24 corresponding to the sides of the top panel 23. A wind direction plate 25A is provided to each air outlet 25. The wind direction plates 25A change the directions of air blown out of the respective air outlets 25 after the temperature of the air is adjusted. The decorative panel 22 also has a rectangular suction grill 26 at its central portion.

The indoor unit 2 also has the blower 27, a bell mouth 28, an air filter 29, a drain pan 30, an indoor-side heat exchanger 10, and the like within the casing 21.

The blower 27 is a centrifugal blower (turbofan) with an impeller 31 and a fan motor 32. The blower 27 is disposed in such a manner that an inlet port 33 of the blower 27 faces the suction grill 26 of the decorative panel 22. The bell mouth 28 is disposed between the inlet port 33 of the blower 27 and the suction grill 26.

The air filter 29 has a size to be able to cover the mouth of the bell mouth 28. This air filter 29 is disposed along the suction grill 26 between the bell mouth 28 and the suction grill 26.

The drain pan 30 catches water droplets generated in the indoor-side heat exchanger 10, to prevent the water droplets from falling into the room. This drain pan 30 is disposed below and along the indoor-side heat exchanger 10.

The indoor-side heat exchanger 10 has a plurality of thin plate-like fins 34, 34, . . . and a plurality of heat transfer pipes 35, 35, . . . that are inserted through through-holes provided in each of the fins 34. The indoor-side heat exchanger 10 is a so-called cross-fin type heat exchanger. The indoor-side heat exchanger 10 is disposed so as to surround the centrifugal blower 27 (the impeller 31) in the horizontal direction. This indoor-side heat exchanger 10 exchanges heat between the refrigerant flowing through the heat transfer pipes 35 and indoor air (outside air) blown out of the centrifugal blower 27, via the pipe walls of the heat transfer pipes 35 and the fins 34. Note that the indoor-side heat exchanger 10 of the present embodiment has seven heat transfer pipes 35 (i.e., the indoor-side heat exchanger 10 of the present embodiment has seven paths), but the number of the heat transfer pipes is not limited to seven. The indoor-side heat exchanger 10 may have two to six heat transfer pipes 35 or 8 or more than 8 heat transfer pipes 35.

Figure 4A:
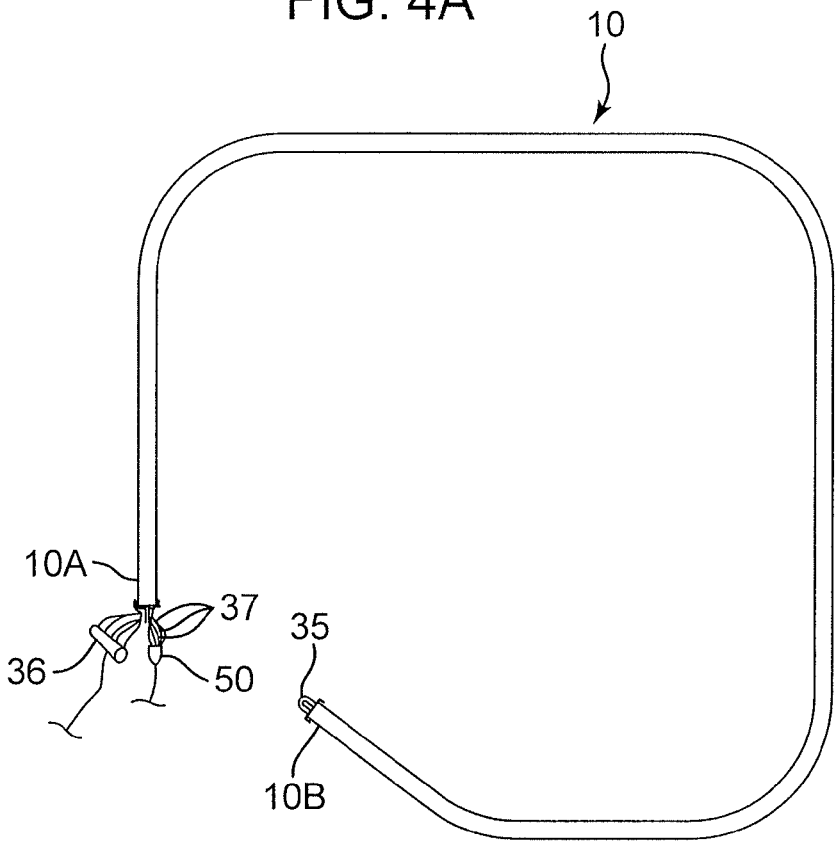
FIG. 4A is a plan view of an indoor-side heat exchanger.
Figure 4B:
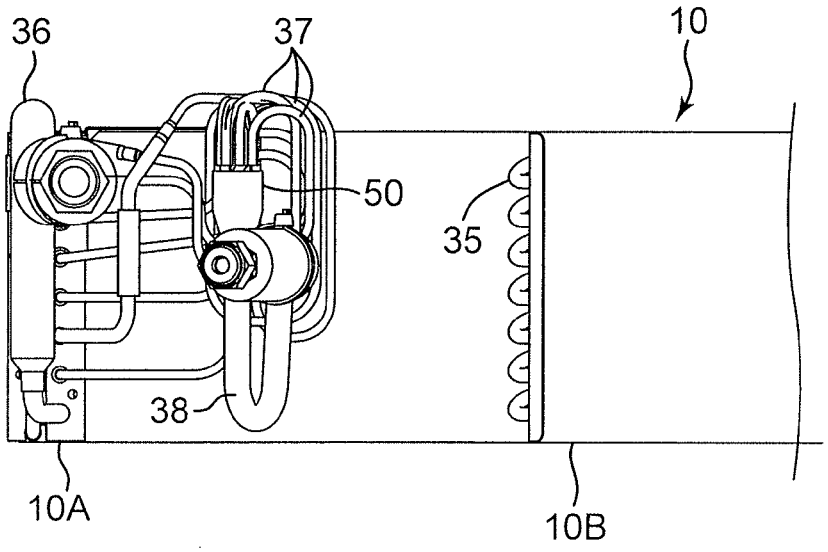
FIG. 4B is an enlarged view showing a state of connection between the indoor-side heat exchanger and a first flow diverter and a header.

As shown in FIGS. 4A and 4B as well, the first flow diverter 50 and a header 36 are connected to the indoor-side heat exchanger 10. In the cooling operation of the air conditioner 1, the first flow diverter 50 allows diversion of the refrigerant flowing from the expansion valve 14 in the refrigerant circuit and then let the refrigerant flow out to the heat transfer pipes 35 of the indoor-side heat exchanger 10. Then, after the refrigerant supplied from the heat transfer pipes passes through the indoor-side heat exchanger 10, the header 36 combines the refrigerant and lets the refrigerant flow out toward the compressor 12. In the heating operation of the air conditioner 1, on the other hand, the header 36 divides the refrigerant flowing from the compressor 12 in the refrigerant circuit and then lets the refrigerant flow out to the heat transfer pipes 35 of the indoor-side heat exchanger 10. Then, after the refrigerant supplied from the heat transfer pipes 35 passes through the indoor-side heat exchanger 10, the first flow diverter 50 combines the refrigerant and lets the refrigerant flow out toward the expansion valve 14. In other words, in the refrigerant circuit, the first flow diverter 50 is connected to the indoor-side heat exchanger 10 on the expansion valve 14 side, whereas the header 36 is connected to the indoor-side heat exchanger 10 on the compressor 12 side. In the indoor-side heat exchanger 10 of the present embodiment, each of the heat transfer pipes 35 extends from one end 10A of the indoor-side heat exchanger 10 to the other end 10B of the same, wherein each heat transfer pipe 35 is folded into a U-shape at the other end 10B and extends to the end 10A. In other words, in the indoor-side heat exchanger 10, each of the heat transfer pipes 35 is disposed such that either end thereof is located at the end 10A. The first flow diverter 50 is connected to one of the ends of each heat transfer pipe 35 by pipes (capillary tubes) 37. The header 36 is connected to the other end of each heat transfer pipe 35.

Figure 5:
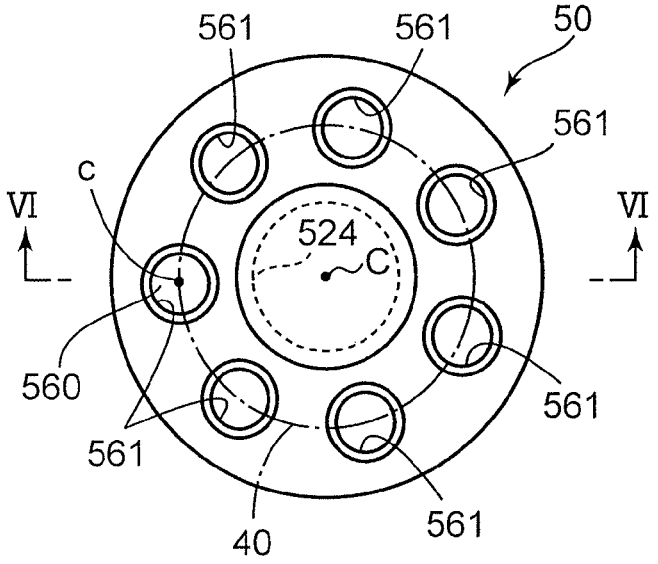
FIG. 5 is a plan view of the first flow diverter.
Figure 6:
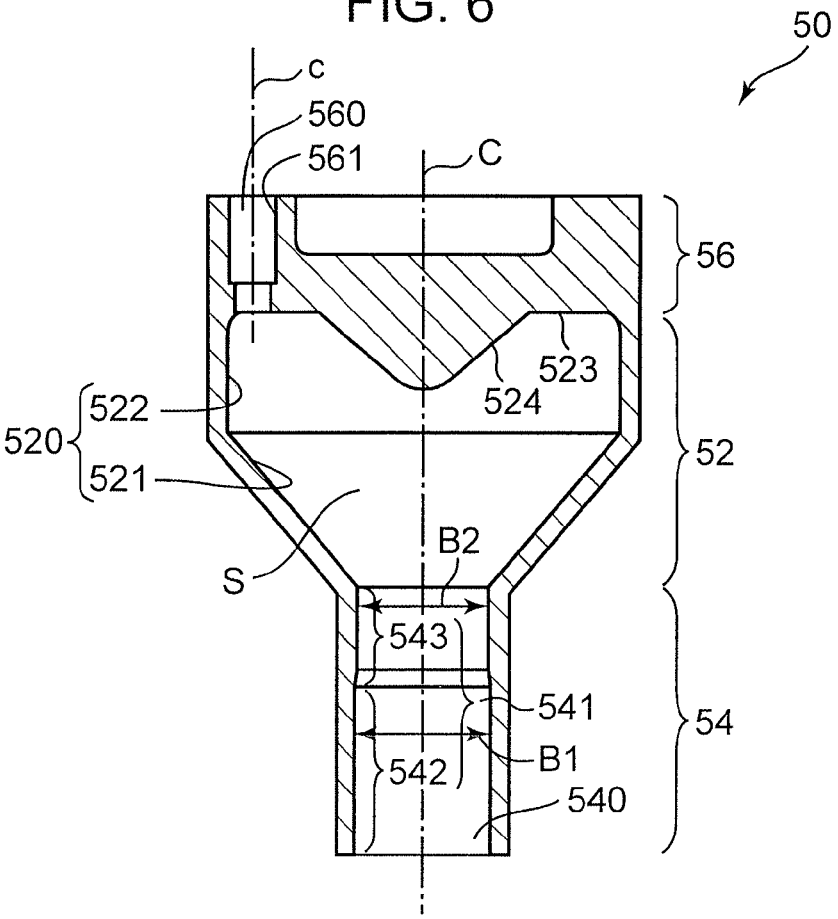
FIG. 6 is a cross-sectional diagram of the position taken along line VI-VI of FIG. 5.
Figure 7:
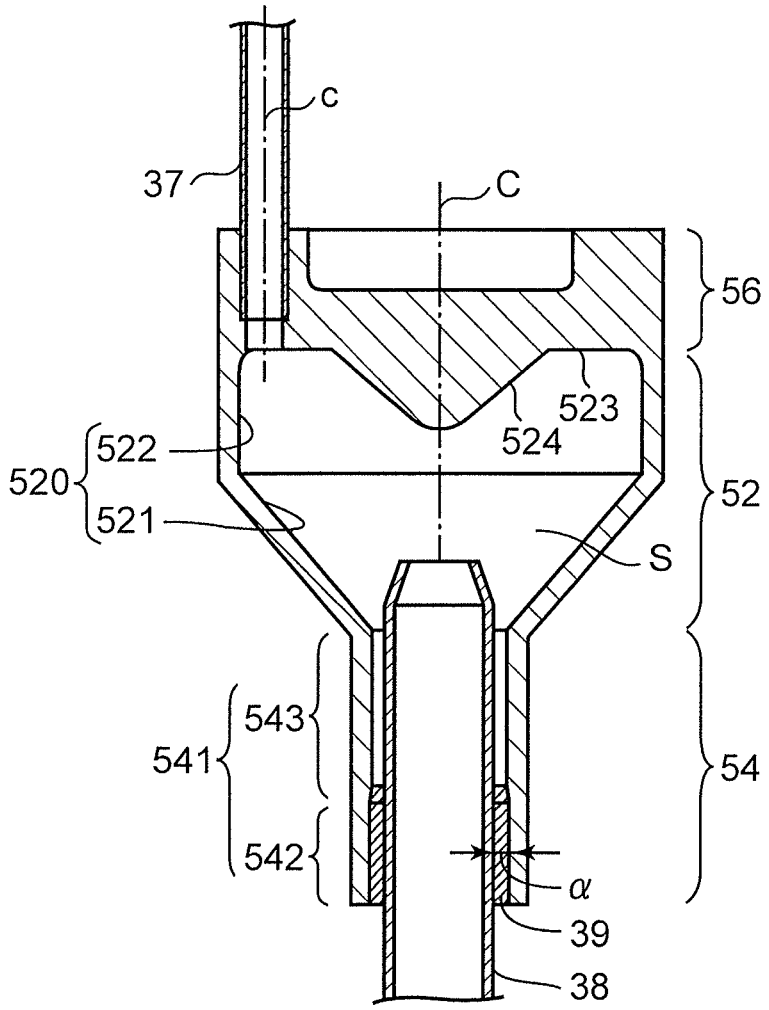
FIG. 7 is a vertical cross-sectional diagram of a flow diverter to which an expansion valve-side pipe and a capillary tube are connected.

Specifically, the first flow diverter 50 has a flow diverter main body 52 having a space S therein (an internal space), and first a connection portion 54 and a second connection portion 56 provided on either side of the flow diverter main body 52 so as to sandwich the flow diverter main body 52 therebetween, as shown in FIGS. 5 to 7. In the first flow diverter 50, the first connection portion 54, the flow diverter main body 52, and the second connection portion 56 are arranged side-by-side along central axis C of the flow diverter 50.

The flow diverter main body 52 has an inner surface 520 surrounding the internal space S. This inner surface 520 is shaped with rotational symmetry about the central axis C as a center. Specifically, the inner surface 520 has a tapering portion 521 of which the inner diameter increases gradually from the first connection portion 54 toward the second connection portion 56, and a large-diameter portion 522 with a constant inner diameter. The center of an end surface 523 of the large-diameter portion 522 on the second connection portion 56 side is provided with a protruding portion 524 that protrudes toward the first connection portion 54 into a substantially cone shape.

The refrigerant flowing from the first connection portion 54 through the internal space S toward the second connection portion 56 along the central axis C is dispersed by this protruding portion 524 toward the outside (toward the peripheral surface side of the large-diameter portion 522) along the protruding portion 524 (conical surface) in such a manner as to be dispersed uniformly in various locations in the peripheral direction.

A pipe (an expansion valve-side pipe) 38 leading to the expansion valve 14 in the refrigerant circuit is connected to the first connection portion 54, so that the inside of the expansion valve-side pipe 38 is communicated with the internal space S of the flow diverter main body 52. The first connection portion 54 has an inner peripheral surface 541 that surrounds (defines) a pipe connection hole 540 that is fixed with the expansion valve-side pipe 38 inserted therethrough. In other words, the pipe connection hole 540 penetrating along the central axis C is formed in the first connection portion 54. The first connection portion 54 of the present embodiment has a substantially cylindrical shape with both ends opened.

With this pipe connection hole 540 formed in the first connection portion 54, the specific shape of the outer peripheral surface of the first connection portion 54 is not limited. In other words, the shape of the outer peripheral surface of the first connection portion 54 according to the present embodiment forms a cylindrical shape coaxial with the pipe connection hole 540 (the inner peripheral surface 541), but may form a prismatic shape or the like.

The inner peripheral surface 541 of the first connection portion 54 has a brazing portion 542 in the direction of the central axis C, which is provided at a location containing an end on the side where the expansion valve-side pipe 38 is inserted (the lower side in FIG. 6), and a restricting portion 543 for restricting inclination of the expansion valve-side pipe 38 at the time of brazing.

The brazing portion 542 configures a cylindrical surface that has an inner diameter (a first inner diameter) B1 large enough to form a gap $\alpha$ between the brazing portion 542 and the outer peripheral surface of the expansion valve-side pipe 38, the gap $\alpha$ being filled with solder 39 for brazing. The restricting portion 543 configures a cylindrical surface through which the expansion valve-side pipe 38 can be inserted and that has an inner diameter (a second inner diameter) B2 smaller than the first inner diameter B1. The end of the restricting portion 543 near the brazing portion 542 (the connection between the restricting portion 543 and the brazing portion 542) is in a tapered shape.

The brazing portion 542 and the restricting portion 543 are joined to each other in such a manner that the central axes thereof are in line with each other on the same straight line (the central axis C of the first flow diverter 50). In other words, the restricting portion 543 is located closer to the flow diverter main body 52 (the upper side in FIG. 6) than to the brazing portion 542 in the inner peripheral surface 541. In the present embodiment, the length dimension of the restricting portion 543 in the direction of the central axis C is smaller than that of the brazing portion 542.

With the expansion valve-side pipe 38 inserted into the pipe connection hole 540 that is surrounded by the inner peripheral surface 541, the space (gap) $\alpha$ between the brazing portion 542 and the outer peripheral surface of the expansion valve-side pipe 38 is filled with the solder 39, and thereby the expansion valve-side pipe 38 is connected (brazed) to the first connection portion 54.

More specifically, the first inner diameter B1 and the length dimension of the brazing portion 542 are set to be able to ensure brazing strength. Because the minimum value of the length dimension of the brazing portion 542 is determined by law (High Pressure Gas Safety Act), the length dimension of the brazing portion 542 is greater than this minimum value.

Note that it is difficult to understand the difference in length between the first inner diameter B1 and the second inner diameter B2 if the dimensional ratio between the first inner diameter B1 and the second inner diameter B2 is accurately described to illustrate the first connection portion 54. Therefore, the difference in length between the first inner diameter B1 and the second inner diameter B2 is overstated in FIGS. 5 to 7.

Each specific size of the restricting portion 543 is determined based on the angle of inclination $\theta$ of the central axis of the expansion valve-side pipe 38 with respect to the central axis C, the angle of inclination being permitted when the expansion valve-side pipe 38 is brazed to the first connection portion 54.

In the second connection portion 56, the plurality of capillary tubes (branched pipes) 37, 37, . . . are connected to each of the heat transfer pipes 35 of the indoor-side heat exchanger 10, so that the inside of each capillary tube 37 is communicated with the internal space S of the flow diverter main body 52. This second connection portion 56 has a plurality of inner peripheral surfaces 561, 561, . . . that surround, respectively, tube connection holes 560 into which the capillary tubes 37 are inserted. In other words, the plurality of tube connection holes 560 penetrating along a central axis c parallel to the central axis C are formed in the second connection portion 56.

The plurality of tube connection holes 560, 560, . . . are disposed side-by-side at intervals on the circumference 40 of a circle around the central axis C. The diameter of the circumference 40 is sized to be able to surround the protruding portion 524 formed in the large-diameter portion 522 of the inner surface 520 of the flow diverter main body 52. In other words, each of the tube connection holes 560 is located on the end surface 523 of the large-diameter portion 522 near the second connection portion 56 and on the outside of the protruding portion 524 (the side away from the central axis C) and penetrates the second connection portion 56 so that the internal space S and the outer portion of the flow diverter 50 are communicated with each other.

In the second connection portion 56 of the present embodiment, seven tube connection holes 560 are disposed side-by-side at equal intervals on the circumference 40. Note that the number of the tube connection holes 560 (the inner peripheral surfaces 561) is not specifically limited. In other words, the number of the tube connection holes 560 of the second connection portion 56 may be changed in accordance with the number of the capillary tubes 37 connected to the second connection portion 56 (the number of the heat transfer pipes 35 provided in the indoor-side heat exchanger 10).

In the flow diverter 50 described above, the refrigerant that flows from the expansion valve-side pipe 38 connected to the first connection portion 54 into the internal space S flows out of each of the capillary tubes 37 connected to the second connection portion 56, and is thereby divided.

Figure 8:
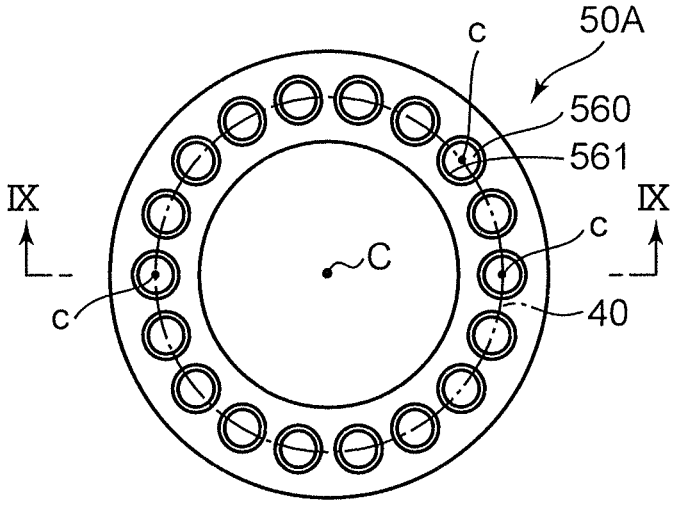
FIG. 8 is a plan view of a second flow diverter provided in an outdoor unit of the air conditioner.
Figure 9:
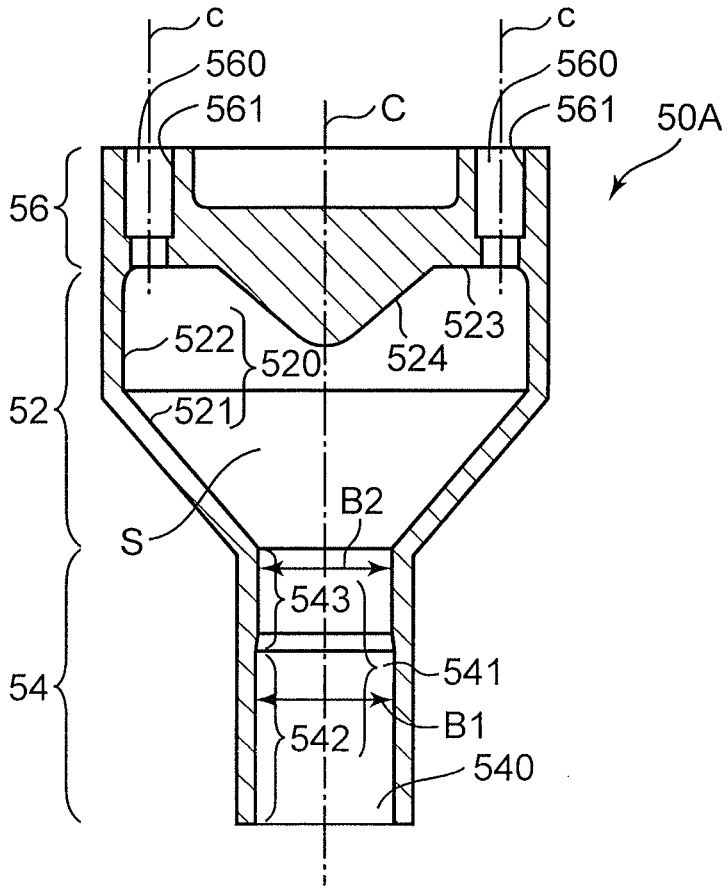
FIG. 9 is a cross-sectional diagram of the position taken along line IX-IX of FIG. 8.

In the outdoor unit 3 as well, the flow diverter (the second flow diverter 50A) is disposed between the outdoor-side heat exchanger 13 and the expansion valve 14 (see FIG. 1). This second flow diverter 50A has the same configuration as the first flow diverter 50, except that eighteen tube connection holes 560 are provided as shown in FIGS. 8 and 9. In other words, in the second flow diverter 50A as well, the first connection portion 54 has the inner peripheral surface 541 that defines the pipe connection hole 540. This inner peripheral surface 541 has the brazing portion 542 and the restricting portion 543. The second inner diameter B2 of the restricting portion 543 is smaller than the first inner diameter B1 of the brazing portion 542.

In the first flow diverter 50 or the second flow diverter 50A of the air conditioner 1 described above, the second inner diameter B2 of the restricting portion 543 is made smaller than the first inner diameter B1 of the brazing portion 542 in the inner peripheral surface 541 of the pipe connection hole 540 (i.e., the first inner diameter B1 is larger than the second inner diameter B2). As a result, a space (gap) $\alpha$ is secured so that the solder 39 for brazing can be poured therein from the side where the expansion valve-side pipe 38 is inserted, facilitating the brazing process. In addition, by reducing the gap between the relevant section of the restricting portion 543 and the outer peripheral surface of the expansion valve-side pipe 38, the expansion valve-side pipe 38 can effectively be prevented from inclining with respect to the first flow diverter 50 or the second flow diverter 50A (the central axis of the pipe connection hole 540) when the brazing process is performed.

Specifically, the narrower the gap between the inner peripheral surface 541 of the pipe connection hole 540 and the outer peripheral surface of the expansion valve-side pipe 38, the more the inclination of the expansion valve-side pipe 38 with respect to the central axis of the pipe connection hole 540 can be restricted. Therefore, the expansion valve-side pipe 38 can reliably be prevented from inclining with respect to the first flow diverter 50 or the second flow diverter 50A (the central axis of the pipe connection hole 540) at the time of the brazing process, by reducing the second inner diameter B2 of the restricting portion 543 and reducing the gap between the restricting portion 543 and the outer peripheral surface of the expansion valve-side pipe 38. Moreover, the brazing portion 542, which has a larger inner diameter than the restricting portion 543 and thereby secures the space (gap) $\alpha$ between the inner peripheral surface thereof and the outer peripheral surface of the expansion valve-side pipe 38 to pour the solder 39 therein, includes the end on the inner peripheral surface 541 on the side where the expansion valve-side pipe 38 is inserted. For this reason, the solder 39 can easily be poured from this end. This can facilitate the process of pouring the solder 39 for brazing.

The air conditioner 1 of the present embodiment has the first flow diverter 50 and the second flow diverter 50A described above. In the air conditioner 1, therefore, the expansion valve-side pipe 38 can be prevented from inclining With respect to the first flow diverter 50 (or the second flow diverter 50A) when being connected to the first flow diverter 50 (or the second flow diverter 50A) at the time of production of the air conditioner 1. Owing to such a configuration, when dividing the refrigerant in the first flow diverter 50 (or the second flow diverter 50A), the refrigerant can be divided uniformly to the capillary tubes 37. In other words, in the air conditioner 1, while being prevented from inclining with respect to the first flow diverter 50 (or the second flow diverter 50A), the expansion valve-side pipe 38 is connected to the first flow diverter 50 (or the second flow diverter 50A). Therefore, the refrigerant flows toward the second connection portion 56 in the direction of the central axis of the pipe connection hole 540 and into the internal space S. Because the distances within the internal space S between the expansion valve-side pipe 38 and the capillary tubes 37 on the circumference 40 of the second connection portion 56 are equal to one another, the refrigerant passing through the internal space S flows into the capillary tubes 37 uniformly.

As a result, the refrigerant that is divided and flows into the heat exchangers 10, 13 (e.g., each of the plurality of heat transfer pipes 35 of the heat exchangers 10, 13) has a uniform flow rate. This effectively prevents deterioration of the efficiency of exchanging heat between the refrigerant and outside air in the heat exchangers 10, 13.

Furthermore, in the first and second flow diverters 50 and 50A of the air conditioner of the foregoing embodiment, the length dimension of the restricting portion 543 in the direction of the central axis C is made smaller than that of the brazing portion 542. For this reason, the entire lengths of the first and second flow diverters 50 and 50A are controlled. In other words, in the air conditioner 1 the minimum value of the length dimension of the brazing portion 542 is defined by law (e.g., by High Pressure Gas Safety Act). Thus, the length dimension of the brazing portion 542 needs to be equal to or greater than this minimum value. However, making the length dimension of the restricting portion 543 smaller than the length dimension of the brazing portion 542 as in the configuration described above can control the entire lengths of the first and second flow diverters 50 and 50A.

Note that the air conditioner of the present invention is not limited to the foregoing embodiment; thus, needless to say, various changes can be made without departing from the spirit of the present invention.

In each of the first and second flow diverters 50 and 50A, of the foregoing embodiment, the length dimension of the restricting portion 543 is made smaller than that of the brazing portion 542 in the direction of the central axis C; however, the configurations of these flow diverters are not limited thereto. The length dimension of the restricting portion may be greater than that of the brazing portion, in such a case where the length dimension of the restricting portion is, for example, 11 mm and the length dimension of the brazing portion is, for example, 7 mm in the direction of the central axis C. In this case, the length dimension of the restricting portion 543 in the central axis C becomes greater, with the gap being small between the inner peripheral surface and the outer peripheral surface of the expansion valve-side pipe 38. Thus, the expansion valve-side pipe 38 can reliably be prevented from inclining with respect to the central axis of the pipe connection hole 540 when connecting the expansion valve-side pipe 38 to the first and second flow diverters 50 and 50A.

The air conditioner 1 may not need to have the four way valve 15. In other words, the air conditioner 1 may be designed only for cooling or heating. In case of the air conditioner 1 designed for cooling, the flow diverter of the outdoor unit 3 may not be configured as the flow diverter 50A of the foregoing embodiment but may be the conventional flow diverter (the flow diverter that does not have the first connection portion 54 that has the pipe connection hole 540 defined by the inner peripheral surface 541 having the brazing portion 542 and the restricting portion 543). In case of the air conditioner 1 designed for heating, the flow diverter of the indoor unit 2 may not be configured as the flow diverter 50 of the foregoing embodiment but may be the conventional flow diverter.

Figure 10A:
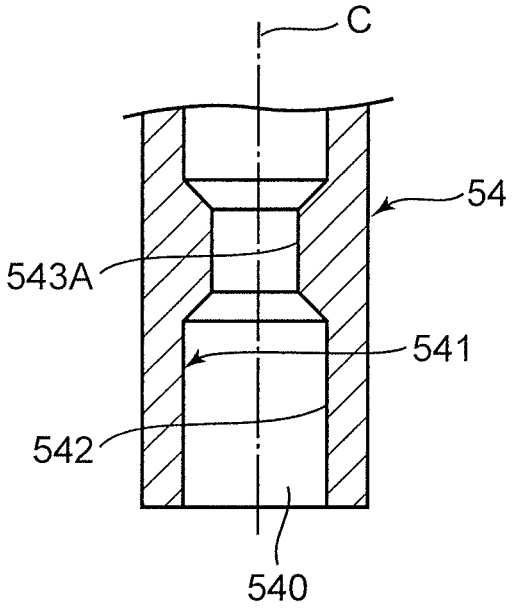
FIGS. 10A and 10B are diagrams for explaining an inner peripheral surface of a first connection portion of a flow diverter according to another embodiment.
Figure 10B:
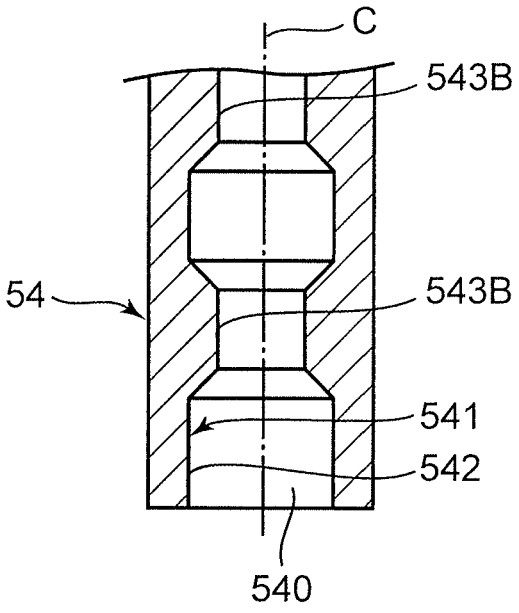
Figure 11A:
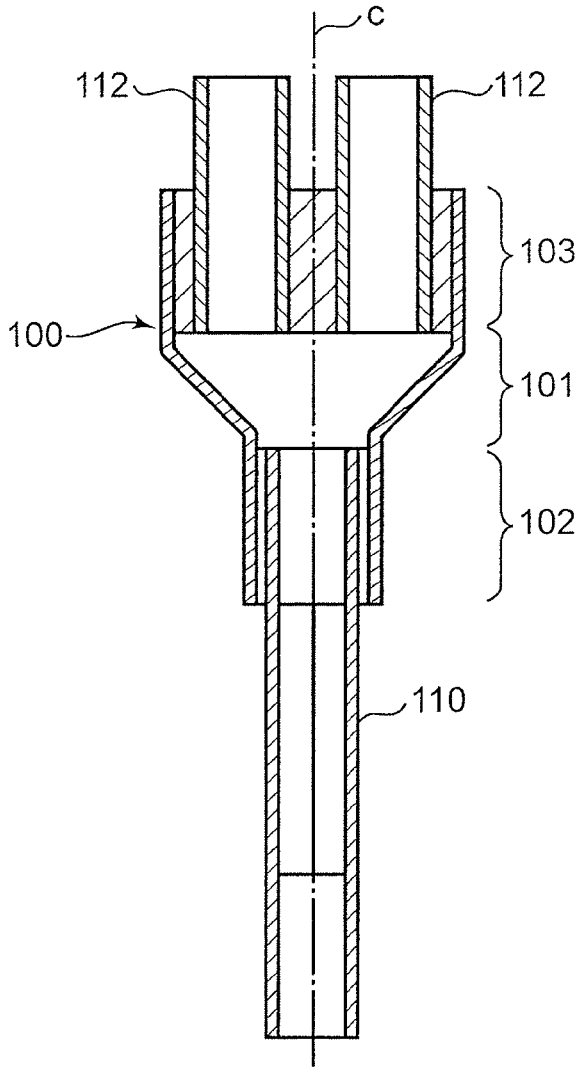
PRIOR ART FIG. 11A
FIG. 11A is a vertical cross-sectional diagram of a conventional flow diverter to which various pipes are connected.
Figure 11B:
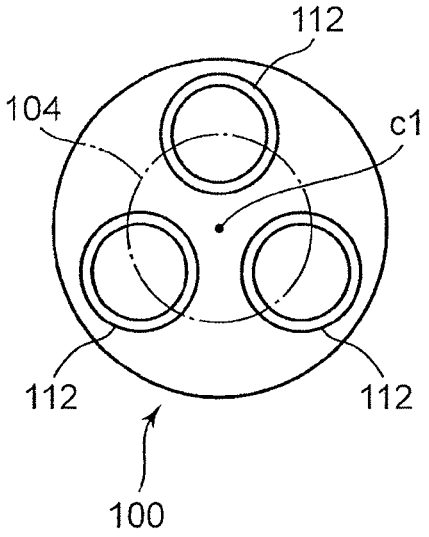
FIG. 11B is a plan view of the flow diverter.
Figure 12:
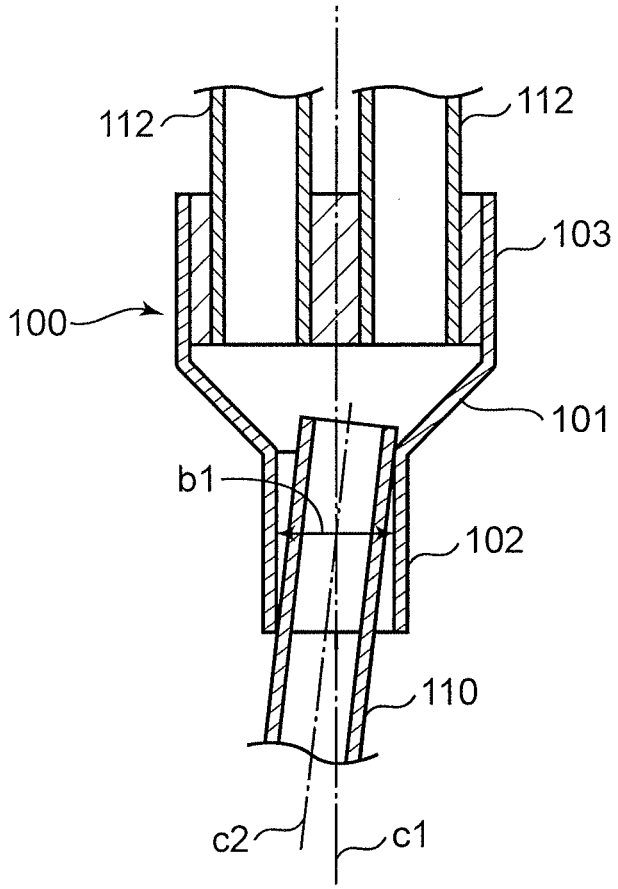
FIG. 12 is a cross-sectional diagram showing a state in which an expansion valve-side pipe is connected obliquely to the conventional flow diverter.

The restricting portion 543 of the foregoing embodiment extends from the end of the brazing portion 542 near the flow diverter main body 52 to the flow diverter main body 52 in the inner peripheral surface 541; however, the region of the restricting portion 543 is not limited thereto. As shown in FIG. 10A, a restricting portion 543A may be provided in the middle of the inner peripheral surface 541 in the central axis C. Furthermore, a plurality of restricting portions 543B may be provided as shown in FIG. 10B.

In the air conditioner 1 of the foregoing embodiment, the first flow diverter 50 or the second flow diverter 50A that has the inner peripheral surface 541 with the brazing portion 542 and the restricting portion 543 is disposed in both the indoor unit 2 and the outdoor unit 3. However, the first flow diverter 50 or the second flow diverter 50A that has the inner peripheral surface 541 with the brazing portion 542 and the restricting portion 543 may be disposed in either the indoor unit 2 or the outdoor unit 3.

The indoor unit 2 of the foregoing embodiment is of a ceiling-suspended type but is not limited to this type. The indoor unit may be of a ceiling-embedded type (so-called cassette type), a room air conditioner, or the like.

SUMMARY OF THE EMBODIMENT

The embodiment described above is summarized below.

The air conditioner according to the foregoing embodiment has: a plurality of branched pipes that are connected to a heat exchanger; an expansion valve-side pipe that leads to an expansion valve; and a flow diverter that is capable of dividing a refrigerant flowing from the expansion valve-side pipe and sending the refrigerant to each of the branched pipes. The flow diverter has a first connection portion that is connected to the expansion valve-side pipe and thereby communicates the inside of the expansion valve-side pipe with an internal space of the flow diverter, and a second connection portion to which each of the plurality of branched pipes is connected and which communicates the inside of each branched pipe with the internal space. The first connection portion has an inner peripheral surface that defines a pipe connection hole to which the expansion valve-side pipe is fixed, with the expansion valve-side pipe being inserted thereto, while the second connection portion is provided with the branched pipes disposed side-by-side at intervals on a circumference of a circle around a central axis of the pipe connection hole. The inner peripheral surface has, in the direction of the central axis a brazing portion, which is provided at a location containing an end on the side where the expansion valve-side pipe is inserted, and forms a gap filled with solder for brazing between the inner peripheral surface and an outer peripheral surface of the expansion valve-side pipe, and a restricting portion for restricting inclination of the expansion valve-side pipe at the time of brazing. The inner diameter of the restricting portion is smaller than that of the brazing portion.

According to this configuration, the brazing process can be facilitated by making the inner diameter of the restricting portion smaller than the inner diameter of the brazing portion in the inner peripheral surface of the pipe connection hole (i.e., making the inner diameter of the brazing portion greater than the inner diameter of the restricting portion) and securing the space (gap) into which the solder for brazing is poured from the side where the expansion valve-side pipe is inserted. In addition, inclination of the expansion valve-side pipe with respect to the flow diverter (the central axis of the pipe connection hole) at the time of the brazing process can effectively be inhibited by making the gap between the restricting portion and the outer peripheral surface of the expansion valve-side pipe narrower than the gap between the brazing portion and the outer peripheral surface of the expansion valve-side pipe. That is described hereinafter in more detail.

The narrower the gap between the inner peripheral surface of the pipe connection hole and the outer peripheral surface of the expansion valve-side pipe, the more the inclination of the expansion valve-side pipe with respect to the central axis of the pipe connection hole can be restricted. Therefore, the gap between the restricting portion and the outer peripheral surface of the expansion valve-side pipe is reduced by making the inner diameter of the restricting portion smaller than the inner diameter of the brazing portion. Consequently, the expansion valve-side pipe can reliably be prevented from inclining with respect to the flow diverter (the central axis of the pipe connection hole) at the time of the brazing process. Moreover, the space (gap) into which the solder is poured can be secured between the brazing portion and the outer peripheral surface of the expansion valve-side pipe by making the inner diameter of the restricting portion bigger than the inner diameter of the brazing portion. Because the brazing portion is provided at the location that includes the end on the inner peripheral surface on the side where the expansion valve-side pipe is inserted, the solder can easily be poured from this end. This can facilitate the process of pouring the solder for brazing.

With this flow diverter, the air conditioner of the foregoing embodiment can prevent the expansion valve-side pipe from inclining with respect to the flow diverter when connecting the expansion valve-side pipe to the flow diverter at the time of production of the air conditioner. Thus, the refrigerant can be divided uniformly to the branched pipes by the flow diverter. In other words, in the air conditioner of the foregoing embodiment, the expansion valve-side pipe, prevented from inclining with respect to the flow diverter, is connected to the flow diverter, so that the refrigerant flows toward the second connection portion along the direction of the central axis into the internal space of the flow diverter. Also, the distances within the internal space between the expansion valve-side pipe and the branched pipes on the circumference of the second connection portion are equal to one another. Thus, the refrigerant passing through the internal space flows into the branched pipes uniformly.

As a result, the refrigerant that is divided and flows into the heat exchanger (e.g., each of the plurality of heat transfer pipes of the heat exchanger) has a uniform flow rate. This effectively prevents deterioration of the efficiency of exchanging heat between the refrigerant and outside air in the heat exchanger.

In the flow diverter of the air conditioner according to the foregoing embodiment, the length dimension of the restricting portion may be smaller than that of the brazing portion in the direction of the central axis.

In the air conditioner, the minimum value of the length dimension of the brazing portion is determined by law (e.g., by High Pressure Gas Safety Act). Even when the length dimension of the brazing portion is set to be equal to or greater than this minimum value, the entire length of the flow diverter can be controlled by making the length dimension of the restricting portion smaller than that of the brazing portion.

In the flow diverter of the air conditioner according to the foregoing embodiment, the length dimension of the restricting portion may be greater than that of the brazing portion in the direction of the central axis.

By making the length dimension of the restricting portion in the central axis greater than the length dimension of the brazing portion, the regulating portion forming a narrow gap together with the outer peripheral surface of the expansion valve-side pipe, the expansion valve-side pipe can reliably be prevented from inclining with respect to the central axis of the pipe connection hole when being connected to the flow diverter.

In the flow diverter of the air conditioner according to the foregoing embodiment, the width of the gap between the outer peripheral surface of the expansion valve-side pipe and the restricting portion may be narrower than the width of the gap between the outer peripheral surface of the expansion valve-side pipe and the brazing portion.

This configuration can prevent the expansion valve-side pipe from inclining with respect to the flow diverter at the time of the brazing process, while securing the space (gap) to be filled with a sufficient amount of solder for tightly brazing the expansion valve-side pipe to the flow diverter.

In the flow diverter of the air conditioner according to the foregoing embodiment the inner peripheral surface of the brazing portion and the inner peripheral surface of the restricting portion may be continued to each other. At least either the end of the inner peripheral surface of the brazing portion on the side of the restricting portion or the end of the inner peripheral surface of the restricting portion on the side of the brazing portion may be shaped such that the inner diameter thereof increases gradually from the restricting portion toward the brazing portion.

INDUSTRIAL APPLICABILITY

The present invention can be used in an air conditioner.

EXPLANATION OF REFERENCE NUMERALS

1 Air conditioner
2 Indoor unit
3 Outdoor unit
10 Indoor-side heat exchanger (Heat exchanger)
13 Outdoor-side heat exchanger (Heat exchanger)
14 Expansion valve
35 Heat transfer pipe of heat exchanger
37 Capillary tube (Branched pipe)
38 Expansion valve-side pipe
39 Solder
40 Circumference
50 First flow diverter (Flow diverter)
50A Second flow diverter (Flow diverter)
52 Flow diverter main body
54 First connection portion
56 Second connection portion
540 Pipe connection hole
541 Inner peripheral surface defining pipe connection hole
542 Brazing portion
543, 543A, 543B Restricting portion
B1 First inner diameter (Inner diameter of brazing portion)
B2 Second inner diameter (Inner diameter of restricting portion)
C Central axis
S internal space
α Gap between brazing portion and outer peripheral surface of expansion valve-side pipe

The invention claimed is:

1. An air conditioner, comprising:

a plurality of branched pipes that are connected to a heat exchanger;

an expansion valve-side pipe that leads to an expansion valve; and a flow diverter that is capable of dividing a refrigerant flowing from the expansion valve-side pipe and sending the refrigerant to each of the branched pipes, wherein the flow diverter has a flow diverter main body having an internal space therein, a first connection portion that is connected to the expansion valve-side pipe and thereby communicates the inside of the expansion valve-side pipe with the internal space of the flow diverter main body, and a second connection portion to which each of the plurality of branched pipes is connected and which communicates the inside of each branched pipe with the internal space, the first connection portion has an inner peripheral surface that defines a pipe connection hole to which the expansion valve-side pipe is fixed, with the expansion valve-side pipe being inserted thereto, while the second connection portion is provided with the branched pipes disposed side-by-side at intervals on a circumference of a circle around a central axis of the pipe connection hole, the inner peripheral surface has, in a direction of the central axis, a brazing portion which is provided at a location containing an end on the side where the expansion valve-side pipe is inserted, and forms a gap filled with solder for brazing between the inner peripheral surface and an outer peripheral surface of the expansion valve-side pipe, and a restricting portion for restricting inclination of the expansion valve-side pipe at the time of brazing, an inner diameter of the restricting portion is smaller than that of the brazing portion, the expansion valve-side pipe is inserted into the internal space through the restricting portion of the pipe connection hole, the flow diverter main body has an end surface which is located on the second connection portion side and is a part of an inner surface surrounding the internal space, and a protruding portion to cause the refrigerant flown into the internal space from the first connection portion to be dispersed toward each of the branched pipes, the protruding portion having a shape such that a diameter of the protruding portion gradually decreases from the end surface toward the first connection portion, the inner surface has a tapering portion having an inner diameter which increases gradually from the first connection portion toward the second connection portion, and a large-diameter portion having a constant inner diameter and located between the tapering portion and the end surface, and the protruding portion has a tip end located between the end surface and a boundary defined by the tapering portion and the large-diameter portion.

2. The air conditioner according to claim 1, wherein a length dimension of the restricting portion is smaller than that of the brazing portion in the direction of the central axis.

3. The air conditioner according to claim 2, a width of a gap between the outer peripheral surface of the expansion valve-side pipe and the restricting portion is smaller than a width of the gap between the outer peripheral surface of the expansion valve-side pipe and the brazing portion.

4. The air conditioner according to claim 2, wherein the brazing portion and the restricting portion are continued to each other, and at least either an end of the brazing portion on the side of the restricting portion or an end of the restricting portion on the side of the brazing portion is shaped such that an inner diameter thereof increases gradually from the restricting portion toward the brazing portion.

5. The air conditioner according to claim 1, wherein a length dimension of the restricting portion is greater than that of the brazing portion in the direction of the central axis.

6. The air conditioner according to claim 5, a width of a gap between the outer peripheral surface of the expansion valve-side pipe and the restricting portion is smaller than a width of the gap between the outer peripheral surface of the expansion valve-side pipe and the brazing portion.

7. The air conditioner according to claim 5, wherein the brazing portion and the restricting portion are continued to each other, and at least either an end of the brazing portion on the side of the restricting portion or an end of the restricting portion on the side of the brazing portion is shaped such that an inner diameter thereof increases gradually from the restricting portion toward the brazing portion.

8. The air conditioner according to claim 1, a width of a gap between the outer peripheral surface of the expansion valve-side pipe and the restricting portion is smaller than a width of the gap between the outer peripheral surface of the expansion valve-side pipe and the brazing portion.

9. The air conditioner according to claim 8, wherein the brazing portion and the restricting portion are continued to each other, and at least either an end of the brazing portion on the side of the restricting portion or an end of the restricting portion on the side of the brazing portion is shaped such that an inner diameter thereof increases gradually from the restricting portion toward the brazing portion.

10. The air conditioner according to claim 1, wherein the brazing portion and the restricting portion are continued to each other, and at least either an end of the brazing portion on the side of the restricting portion or an end of the restricting portion on the side of the brazing portion is shaped such that an inner diameter thereof increases gradually from the restricting portion toward the brazing portion.

* * * * *